United States Patent [19]

Councell, Jr. et al.

[11] 4,410,050

[45] Oct. 18, 1983

[54] MACHINE FOR INSERTING RIGID MEMBERS IN THE SOIL

[75] Inventors: William S. Councell, Jr., Goldsboro; Garland L. Turner, Hillsboro, both of Md.

[73] Assignee: Councell Nurseries, Inc., Goldsboro, Md.

[21] Appl. No.: 340,023

[22] Filed: Jan. 18, 1982

[51] Int. Cl.[3] ..... E21B 15/04; B23B 45/16

[52] U.S. Cl. ..... 173/112; 173/45; 173/22; 254/29 K; 414/745; 227/120; 227/111

[58] Field of Search ..... 173/112, 22, 24, 25, 173/26, 45; 414/23, 745, 748; 227/110, 111, 120; 254/29 R, 30

[56] References Cited

U.S. PATENT DOCUMENTS

| | | | |
|---|---|---|---|
| 2,018,129 | 10/1935 | Jackson | 173/22 |
| 2,576,467 | 11/1951 | Lukens | 61/75 |
| 2,637,287 | 5/1952 | Strauss | 111/3 |
| 2,655,006 | 10/1953 | Hoen et al. | 173/112 |
| 2,776,110 | 1/1957 | Hoistad | 254/29 R |
| 3,156,308 | 11/1964 | De Forest | 173/22 X |
| 3,446,296 | 5/1967 | Anderson | 173/45 X |

*Primary Examiner*—E. R. Kazenske
*Assistant Examiner*—Willmon Fridie, Jr.
*Attorney, Agent, or Firm*—Brady, O'Boyle & Gates

[57] ABSTRACT

A continuously slowly moving machine automatically inserts rigid elongated members in the ground at regular intervals along the perimeter of a large field to facilitate anchoring a taut textile net placed over seedling grass. Several thousand of the members must be inserted around the perimeter of a typical turf-growing plot at a spacing of a few feet apart. Ground wheels of a moving frame generate movement of a carriage which travels horizontally on the moving frame rearwardly and forwardly. The carriage supports the inserting mechanism for the members which includes a single inserting upright cylinder and a connected coordinated delivery plunger for each member advancing each member to a ready vertical position beneath the rod of the cylinder. When the carriage is at the rear of its travel relative to the moving frame substantially at zero ground speed, a member is inserted in the soil by the rod of the cylinder accompanied by simultaneous retraction of the delivery plunger. The several machine movements are precisely timed and coordinated.

14 Claims, 15 Drawing Figures

FIG.10
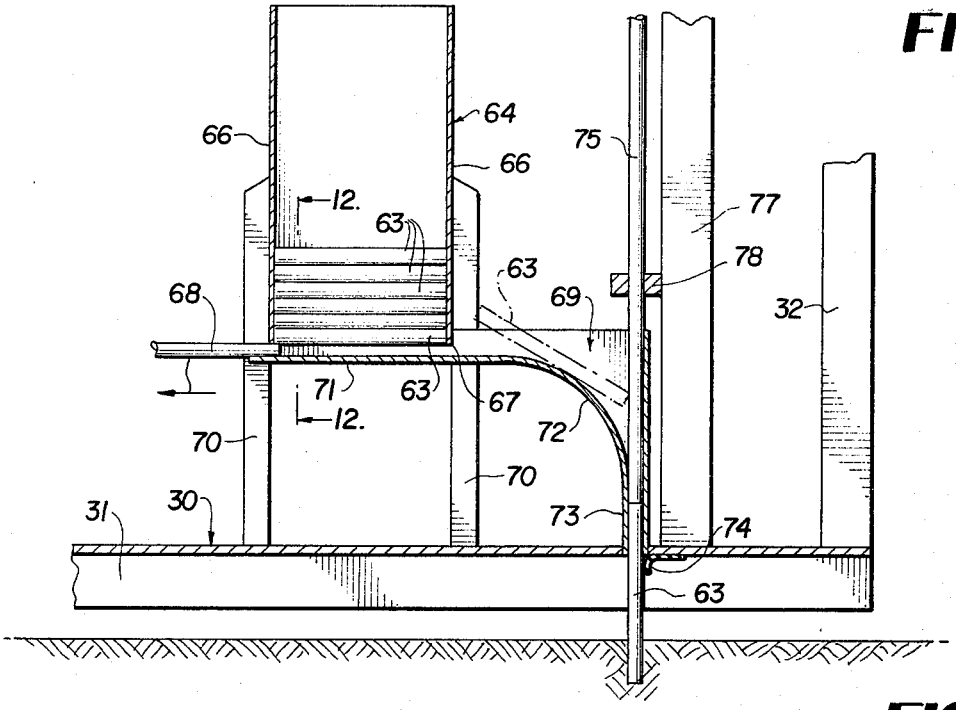
FIG.11
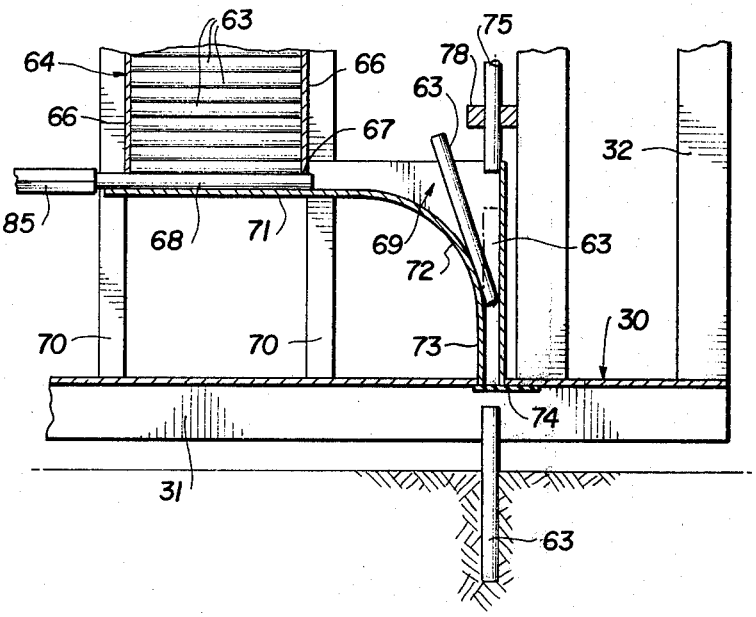
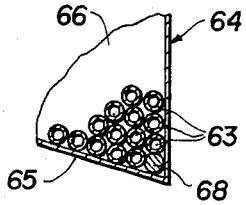
FIG.12
FIG.6
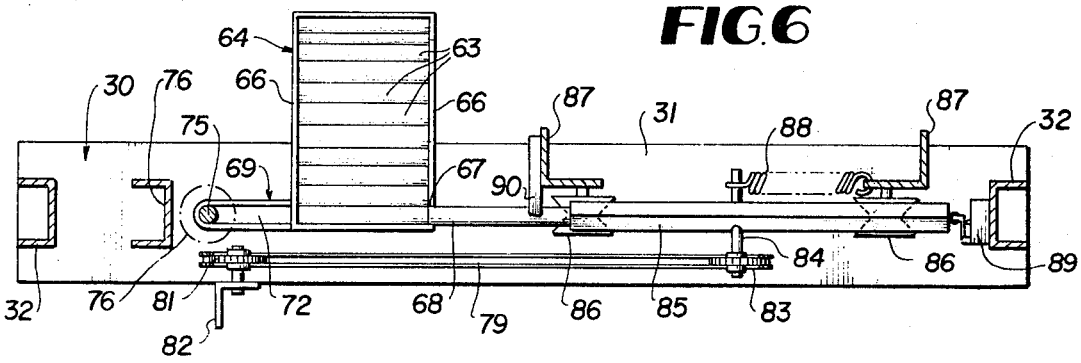

FIG. 7
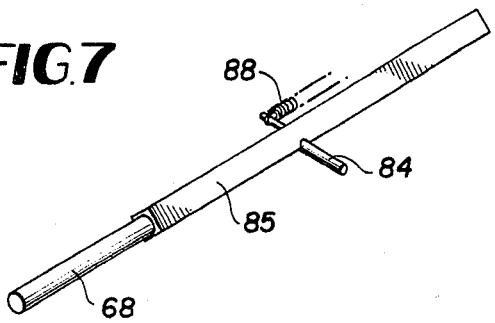
FIG. 8
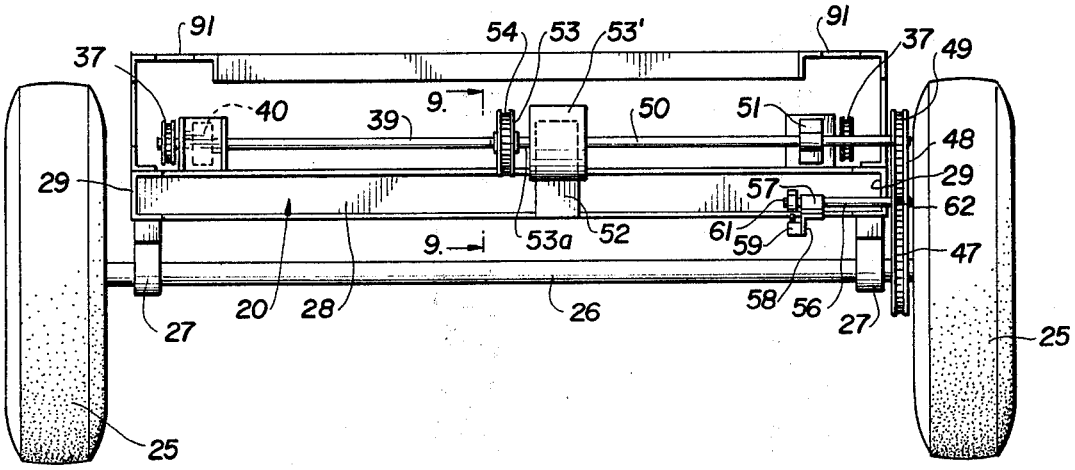
FIG. 9
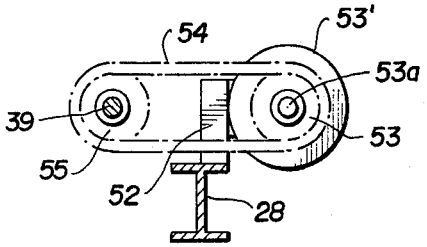
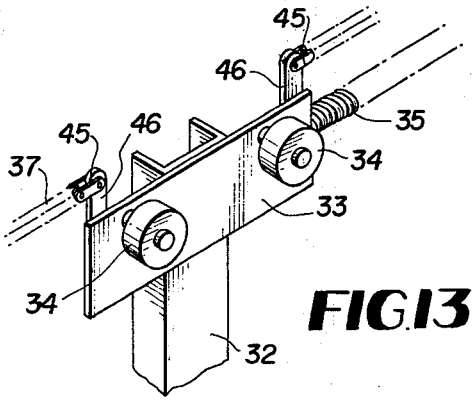
FIG. 13
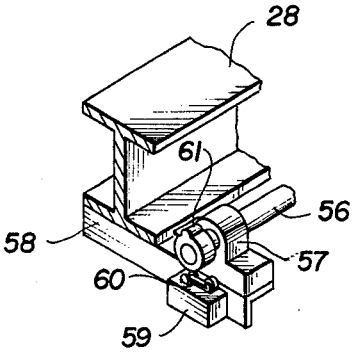
FIG. 14

MACHINE FOR INSERTING RIGID MEMBERS IN THE SOIL

BACKGROUND OF THE INVENTION

Successful growing of grass turf or sod on a commercial scale requires the covering of seedling grass with a special textile netting designed for this purpose. The netting is stretched over the growing area which may be many acres and is engaged with rigid members inserted in the soil at regular intervals around the margin of the plot. The inserting operation when carried out manually is extremely laborious and costly. Accordingly, it is the objective of the invention to eliminate this manual labor and reduce the cost of inserting the rigid members into the soil at regular intervals through provision of a simplified and compact self-contained automatic inserting machine which may be tractor drawn and can derive its power from the power take-off shaft of the tractor and from the tractor electrical system. Ideally, the invention is realized in a continuously moving machine which travels at a speed approximating $1\frac{1}{4}$ to $1\frac{1}{2}$ miles per hour and automatically inserts elongated rigid members into the soil vertically at a rate of twenty-two per minute which results in a uniform spacing of the members of approximately four feet apart.

The member inserting machine in essence comprises a wheeled frame adapted to be drawn by a tractor, a movable carriage on the frame adapted to move horizontally forwardly and rearwardly thereon, a member delivery and inserting mechanism and a member supply hopper on the carriage bodily moving therewith, and power drive means for the carriage and the member inserting and delivery mechanism including the ground wheels of the frame, gearing between such wheels and the carriage, and a single inserting power cylinder whose movements are transmitted mechanically to a delivery plunger for the members which are held in a storage hopper on the carriage. The inserting cylinder for the members receives motive fluid from a reservoir on the wheeled frame through a pump connected with the power take-off shaft of the tractor and solenoid operated valve electrically coupled with switches in a control box on the wheeled frame. Cooperative timing switches and an electrical clutch initiating and terminating rearward carriage movement and provided.

Additional features and advantages of the invention over the known prior art will become apparent during the course of the following description.

BRIEF DESCRIPTION OF THE DRAWINGS

FIG. 6 is a horizontal section taken on line 6—6 of FIG. 5.

FIG. 7 is a perspective view of a delivery plunger for inserted members.

FIG. 8 is a rear elevation of a wheeled frame and associated parts forming the body portion of the machine.

FIG. 9 is an enlarged fragmentary vertical section taken on line 9—9 of FIG. 8.

FIG. 10 is an enlarged fragmentary vertical section taken on line 10—10 of FIG. 3.

FIG. 11 is a view similar to FIG. 10 with cooperative parts shown in different operative positions from the positions shown in FIG. 10.

FIG. 12 is a fragmentary vertical section taken on line 12—12 of FIG. 10.

FIG. 13 is a fragmentary perspective view of carriage drive components.

FIG. 14 is a fragmentary perspective view of a timer cam and associated elements.

DETAILED DESCRIPTION

Figure 1:
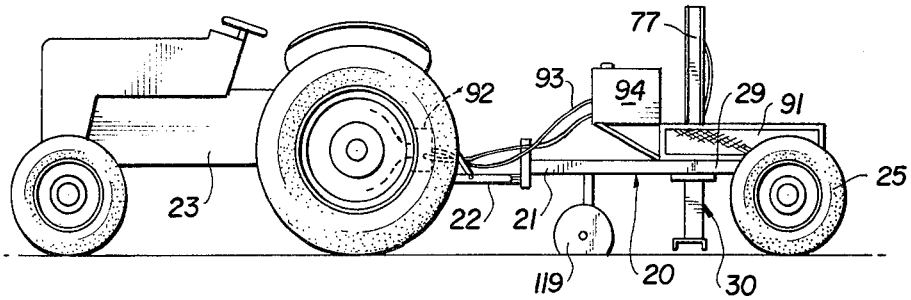
FIG. 1 is a side elevation of a rigid member inserting machine according to the invention.

Referring to the drawings in detail wherein like numerals designate like parts, a machine for automatically inserting elongated rigid members in the ground at regular intervals comprises a horizontal wheeled frame 20 forming the body portion of the machine and including a forward draft tongue 21 adapted to be coupled to the drawbar 22 of a farm tractor 23 having a power take-off shaft 24.

The frame 20 is supported at its rear end by ground wheels 25 on a transverse axle 26 held in bearings 27 depending from the sides of frame 20. Above the axle 26 is a rigid transverse cross beam 28 whose opposite ends are rigid with side parallel channel members 29 of the frame 20.

Mounted for fore and aft movement on the frame 20 in accordance with an important aspect of the invention is an underslung transverse carriage 30 consisting of a bottom sturdy transverse horizontal channel 31 having side upstanding vertical arms 32 rigidly attached thereto. The tops of the arms 32 on their outer sides have carriage plates 33 rigidly secured thereto, the plates 33 carrying pairs of horizontally spaced guide rollers 34 which rollingly engage the channels 29.

The carriage 30 is biased toward a forward position on the wheeled frame 20 by opposite side retractile springs 35 connected between the plates 33 and a forward cross beam 36 of the frame 20. At proper times, the carriage 30 is propelled rearwardly on the channels 29 of frame 20 by drive chains 37 engaged with rear sprockets 38 secured to a horizontal transverse shaft 39 held in bearings 40 seated on the cross beam 28. The chains 37 are similarly engaged with front sprockets 41 mounted on another transverse shaft 42 held in bearings 43 on upright frame members 44.

Figure 4:
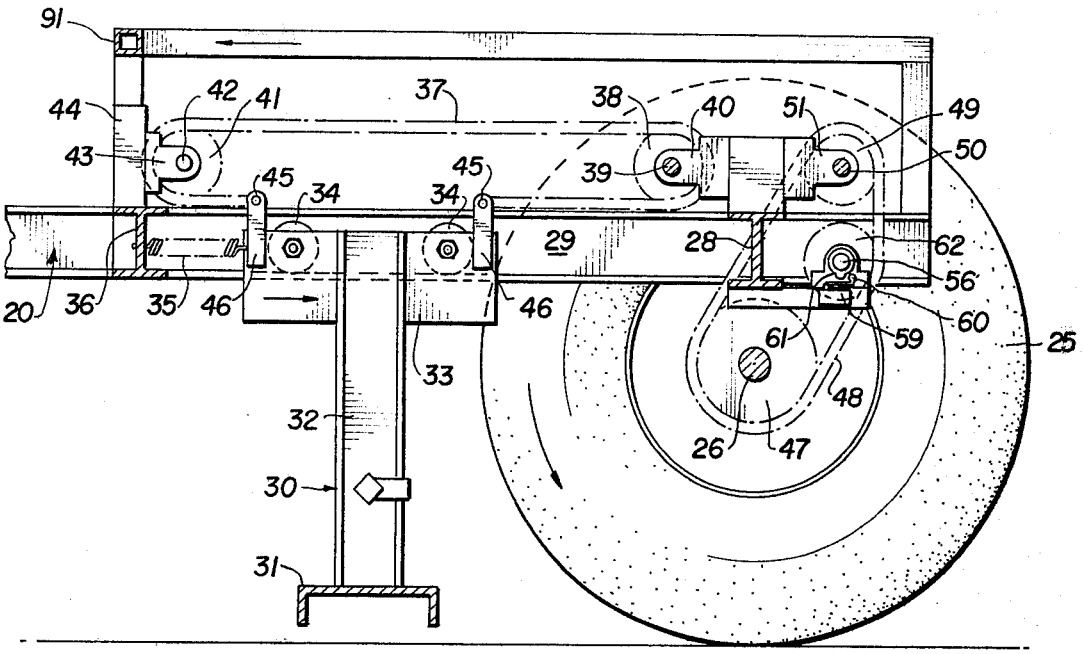
FIG. 4 is an enlarged fragmentary longitudinal vertical section taken on line 4—4 of FIG. 3.
Figure 5:
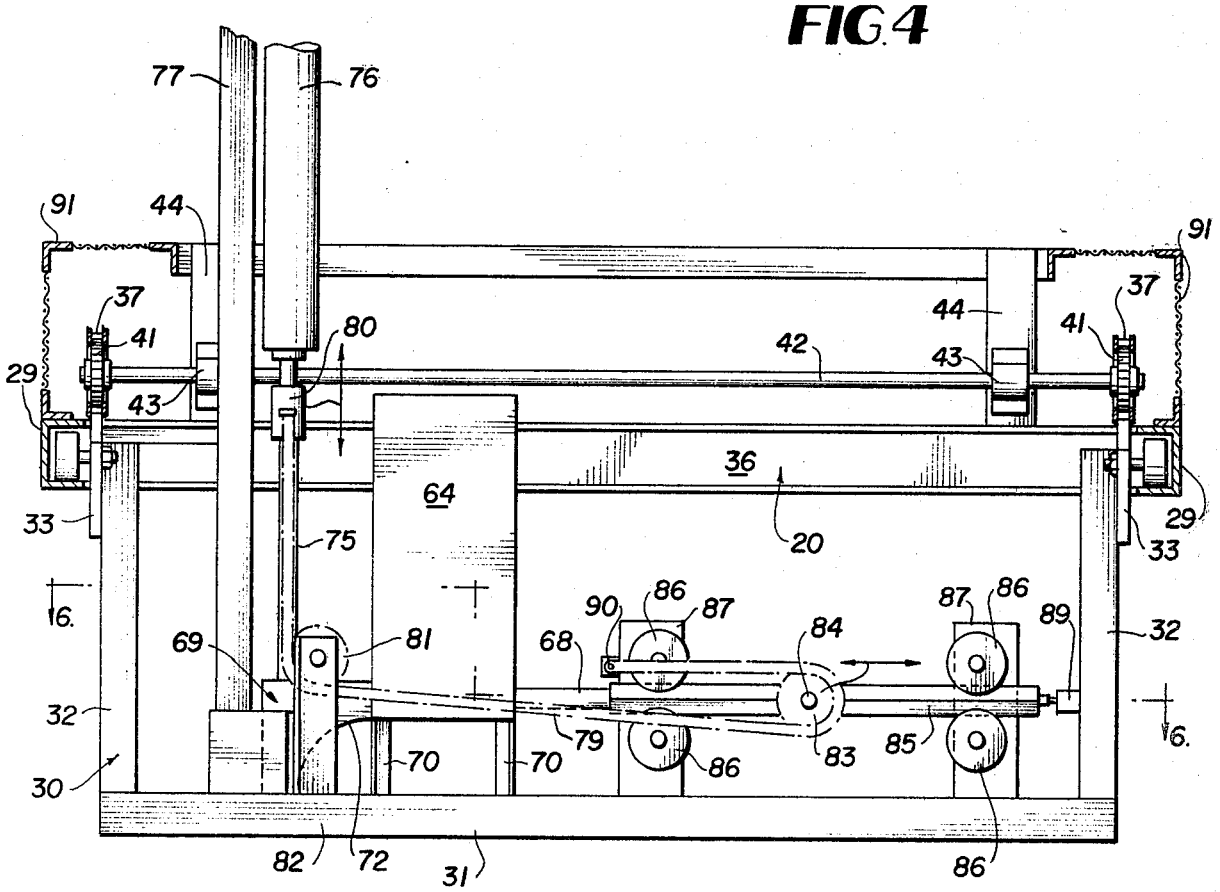
FIG. 5 is an enlarged transverse vertical section taken on line 5—5 of FIG. 3.

The opposite end terminals of chains 37 are connected at 45, FIGS. 4 and 13, to fixed lugs 46 on the plates 33. Power to drive the carriage 30 rearwardly on the frame 20 against the biasing force of springs 35 is produced by the forward rolling of the two ground wheels 25 whose axle 26 has a sprocket 47 secured thereto between one wheel 25 and the adjacent bearing 27. An endless chain 48 engaged with sprocket 47 is also engaged with a sprocket 49 carried by an elevated shaft 50 parallel to the axle 26 and above the frame 20 and somewhat rearwardly of the axle 26, as best shown in FIG. 4.

The shaft 50 which is supported by a bearing 51 atop the beam 28 near its outer end is further supported near the center of the machine by a member 52 welded to the beam 28. At its inner end, the shaft 50 is connected to the input rotary part of a conventional electric clutch 53' whose output rotary part when the clutch is energized and engaged drives a short shaft 53*a* carrying a sprocket 53 engaged by a chain 54 which engages another sprocket 55 on the shaft 39 near the center of the machine. The two shafts 39 and 50 are at the same elevation and are parallel.

A comparatively short timer shaft 56 below the shaft 50 and parallel therewith is journaled in a bearing 57 secured to an arm 58 fixed to the bottom of beam 28, FIG. 14. The arm 58 also mounts an electrical timing switch 59 on one side thereof, whose actuator 60 is tripped by rotation of a single lobe timing cam 61 on shaft 56. The timer shaft 56 is driven by a sprocket 62 engaged with the chain 48 which is also engaged with driving sprocket 47 and overhead sprocket 49 on clutch shaft 50.

It can be seen that when the electric clutch 53' is de-energized and disengaged during forward movement of the machine, rotation of the ground wheels 25 will impart no rotation through the clutch to the chain 54 and shaft 39. Consequently, there will be no movement of the carriage 30 rearwardly on the frame 20, and such rearward movement will occur only when the electric clutch 53' is engaged, as will be further discussed.

Figure 2:
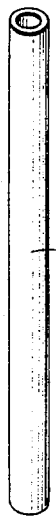
FIG. 2 is a perspective view of an elongated rigid member.

In accordance with another major feature of the invention, cyclically operated means to automatically insert rigid elongated members into the ground at regular intervals is bodily mounted on the carriage 30 to reciprocate therewith. Each inserted member may comprise a 6" long by ½" diameter tube 63 shown in FIG. 2. Other types of members can be inserted by the machine.

The above inserting means on the carriage 30 comprises a supply hopper 64 for a large number of the members 63 in parallel stacked relationship. The floor 65 of hopper 64 slopes, FIG. 12, so that one member 63 will always gravitate to the lower corner of the hopper whose opposite side walls 66 have a through opening 67 at this corner through which each lowermost member 63 may be moved or pushed axially by a delivery plunger 68 into a positioning trough 69 at the outlet side of the hopper 64. The hopper is based on legs 70 rising from the member 31 of carriage 30.

The positioning trough 69 includes a horizontal floor 71 immediately beneath the hopper 64 and in fact comprised of the lower corner of the hopper. The floor or wall 71 leads to a curved descending wall 72, in turn leading to a descending vertical guide portion 73 of the trough 69 having a weak flapper valve 74 at its lower end to temporarily arrest downward movement of each member 63 until the latter is positively acted on by a vertical reciprocatory driving or inserting plunger 75.

It may be understood in FIGS. 10 and 11 that when each member 63 in succession at the bottom corner of the hopper 64 is advanced by the plunger 68 through opening 67 onto the curved wall 72, the member will slide and topple by gravity into the vertical portion 73 of trough 69 and will rest on the flapper element 74 in a vertical position until the inserting plunger rod 75 descends to push the member 63 into the soil at the moment when the carriage 30 is stationary relative to the ground at the rear end of its travel on the frame 20.

The two plungers 68 and 75 have their movements coordinated with each other and also with the fore and aft movement of the carriage 30. The plunger 75 is moved vertically by a single power cylinder 76 supported by an adjacent post 77 rising from the carriage member 31. This post carries at least one guide element 78 for the vertical plunger 75 whose lower end portion must enter the descending vertical section 73 of the trough 69 with some precision.

The vertical plunger rod 75 is mechanically linked to the horizontal plunger 68 by a chain 79 having one end attached as at 80 to the plunger rod 75. The chain 79 engages a guide sprocket 81 supported by a post 82 rising from carriage member 31. The chain engages another sprocket 83 carried by a shaft 84 projecting laterally from a square cross section carriage bar 85 for plunger 68. The carriage bar 85 is supported horizontally and movably on V-rollers 86 supported on posts 87 rising from the member 31. The carriage bar 85 and plunger 68, which are integrally connected, are biased to a retracted position by a spring 88, as best shown in FIG. 6. A control switch 89, whose purpose will be described, is attached to carriage member 32 with its actuator in the path of movement of carriage bar 85 so that the switch will be tripped when plunger 68 is fully retracted from the hopper 64, FIG. 6. It may be seen that when the vertical plunger rod 75 descends under influence of power cylinder 76 to insert a member 63 in the ground, FIG. 10, simultaneously the return spring 88 will cause retraction of plunger 68 to the position shown in FIG. 6 and also in FIG. 10, the other end of the chain 79 being attached at 90 to the post 87. When the plunger rod 75 rises or is retracted by the piston in cylinder 76, as shown in FIG. 11, the horizontal plunger 68 will simultaneously be thrust forwardly with the guided carriage bar 85 to eject one of the members 63 from the bottom of the hopper 64 into the holding and positioning trough 69, as previously described.

For the sake of safety, opposite side screen guards 91 mounted on the wheeled frame 20 enclose the chain gearing components at the opposite sides of the machine.

Figure 3:
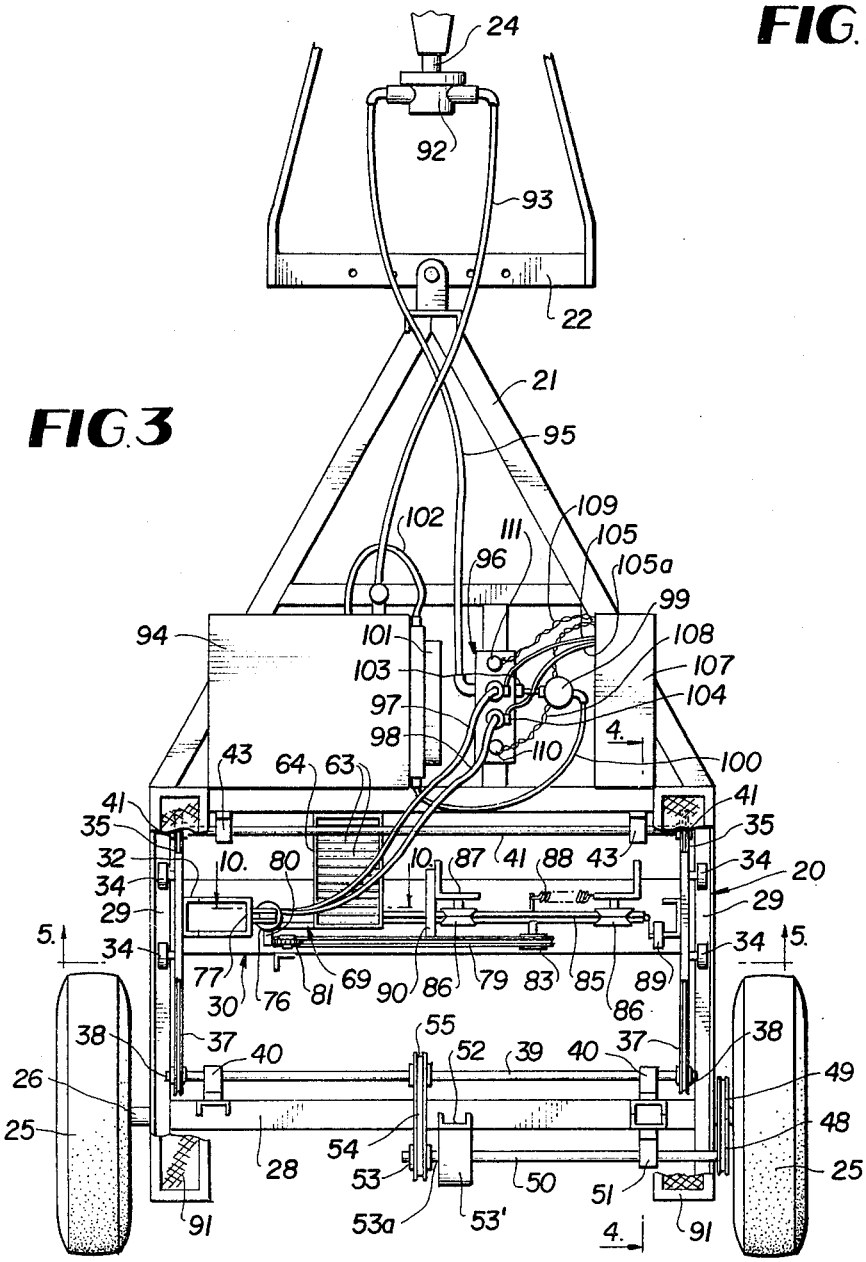
FIG. 3 is a plan view of the machine.

The tractor power take-off shaft 24 drives a hydraulic pump 92 which receives fluid through a line 93 from a tank 94 fixed on the frame 20. The pump delivers pressurized fluid through a line 95 to the inlet of a two position solenoid valve 96 shown in FIGS. 3 and 15. This valve delivers and returns fluid through two lines 97 and 98 depending on the setting of the valve to fittings on the cylinder 76 which is a double-acting cylinder. There is also a filter 99 connected in a return line 100 leading from the two-way valve 96 through a cooler 101 and back to the tank 94 by means of a line 102.

A low pressure sensor 103 and a higher pressure sensor 104 are connected through the two-way valve 96 and through the lines 97 and 98 with the high and low pressure ends of cylinder 76. The greater pressure in the cylinder 76 will be above its piston 76' when a member 63 is being driven downwardly into the ground by the plunger rod 75. A lower pressure in the cylinder below the piston 76' is sufficient to retract the plunger rod 75. The low and high pressure sensors 103 and 104 are connected through lines 105' and 105*a* with low and high pressure switches 105 and 106, respectively, both located in a control box 107 on the frame 20. These two switches, in turn, are electrically connected by wires 108 and 109 with the two solenoids 110 and 111 of two-way spool valve 96.

The solenoids 110 and 111 are connected through wires 112 and 113 with the switch 89 at the rear end of carriage bar 85 carrying plunger 68 and with the conventional DC battery 114 of tractor 23, which battery is series connected with the timer switch 59 operated by cam 61.

Figure 15:
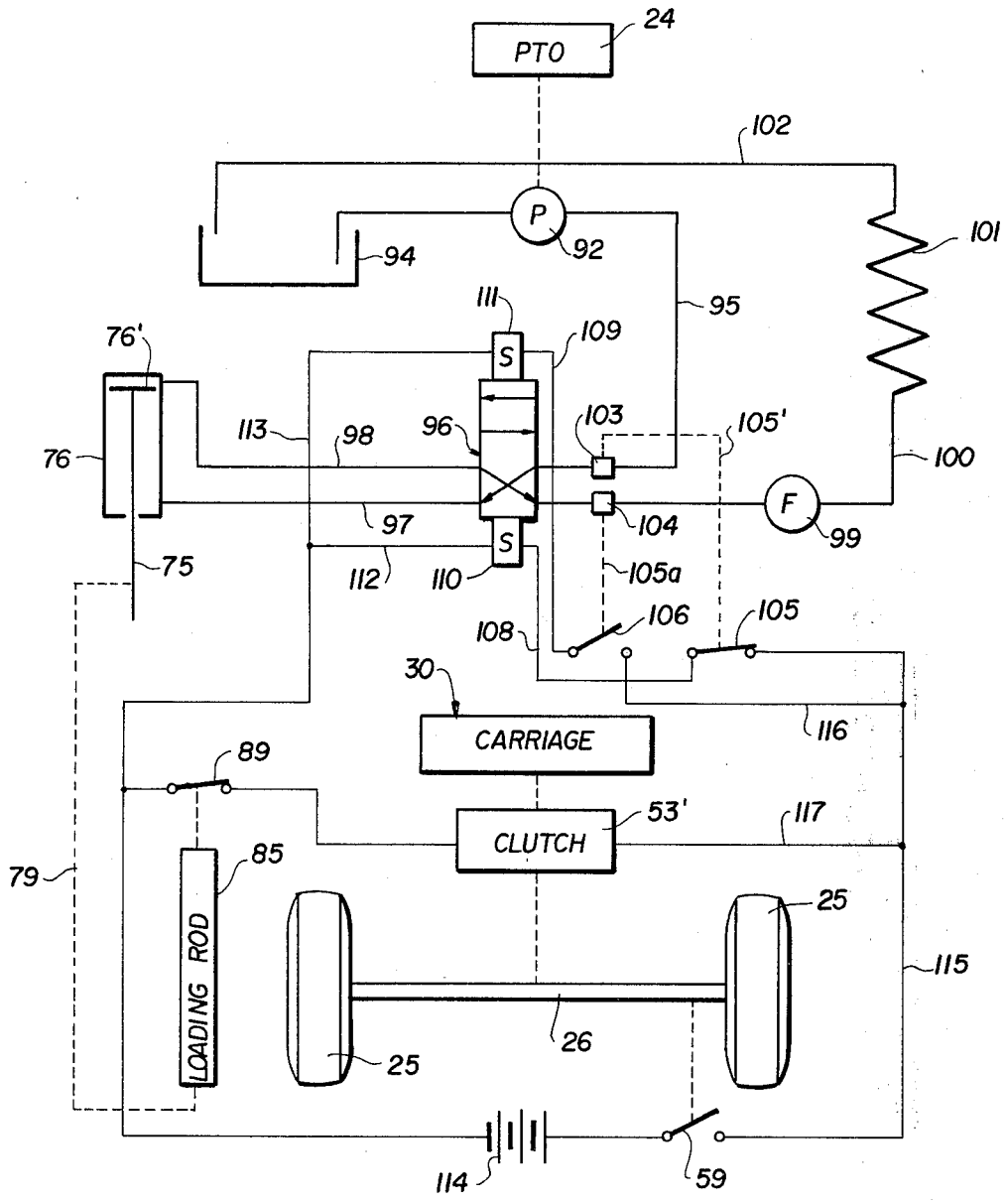
FIG. 15 is an electrical and fluid schematic depicting the relationship of components in the operational cycle of the machine.

One terminal of switch 59 is connected through a wire 115 and another wire 116 with the stationary terminals of pressure switches 105 and 106. Another wire 117 electrically connects the timer switch 59 with a terminal of the electric clutch 53' which controls the rearward movement of carriage 30 on the wheeled frame 20 against the force of return springs 35. The other terminal of electric clutch 53' is connected by a wire 118 with a terminal of switch 89, as shown in FIG. 15.

An optional feature of the invention is to provide a furrow-forming disc 119 depending from the frame 20 forwardly of the vertical plunger rog 75 to continuously cut a narrow furrow or slit in the soil in order to clear it of rocks and other obstructions which would impede the driving of the rigid members 63 into the soil.

Summary of Operations

The machine is pulled forwardly continuously by tractor 23 at a speed of about 1¼ MPH. The power take-off shaft 24 will continuously drive the pump 92 and electrical power is supplied to the system shown in FIG. 15 by the tractor battery 114.

The continuous rotation of ground wheels 25 forwardly through the gearing shown in FIG. 4 causes continuous rotation of timer shaft 56 and cam 61 as well as clutch shaft 50. If the clutch 53' is de-energized, there is no rotation of shaft 39 and therefore no movement of carriage 30, as previously explained.

The rotating cam 61 will trip or close switch 59 and, through wire 115, switch 105 and wire 108, solenoid 110 of valve 96 is energized shifting the valve spool to its second position whereby the pump 92 delivers pressurized fluid to the top of cylinder 76, driving the vertical plunger rod 75 down to insert a member 63 held in the vertical portion 73 of trough 69 into the ground, FIG. 10. Simultaneously, the spring 88 retracts plunger 68 to the reloading position relative to the hopper 64 and another member 63 drops into the horizontal lower corner of the hopper, FIGS. 10 and 12, ready for the next cycle.

Simultaneously with the closing of switch 59 to energize solenoid 110, the electric clutch 53' is energized and engaged to transmit power to the carriage drive shaft 39, thereby causing the carriage to begin moving in a reverse direction relative to the forwardly moving frame 20. This carriage movement occurs while plunger rod 75 is descending.

The switch 89 at the rear of retracting carriage bar 85 will be opened to cause a brief interruption of hesitation of the carriage 30 in its rearward movement, after which the carriage continues rearwardly until reaching the end of its travel. The carriage is returned forwardly by springs 35.

Responding to high pressure above the piston 76' when the member 63 is inserted in the ground through pressure sensor 104, the switch 106 will be closed while switch 105 opens. Through wire 109, solenoid 111 is energized shifting the valve spool to the position shown in FIG. 15 where the pump 92 can deliver fluid through line 97 to the bottom of cylinder 76, retracting and elevating plunger rod 75. When this occurs, the plunger 68 travels forwardly, being driven by chain 79 attached to plunger rod 75, and plunger 68, FIG. 11, advances another element 63 into the positioning trough 69 where such element or member topples into the vertical tubular portion 73 of the chute ready for the next insertion when plunger rod 75 descends.

At the moment of insertion into the ground, the carriage 30 at the rear end of its travel is stationary relative to the ground resulting in each member 63 being driven vertically to the desired depth while the machine moves forwardly without interruption. When moving at a speed not exceeding 1½ MPH, the machine will insert approximately twenty-two objects per minute with consistent precision and uniformity and regular spacing. The entire operation is automatic resulting in a savings of much time and labor. The spacing between inserted members 63 can be varied by changing the diameter of sprocket 49.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. A machine for inserting rigid members into the ground at regular intervals comprising a continuously moving body portion having a substantially horizontal guideway, a carriage on the guideway adapted to move rearwardly and forwardly thereon during the continuous movement of the body portion, a supply of rigid members to be inserted in the ground on said carriage, a guiding and positioning means for said members on the carriage adapted to receive one member at a time from said supply and to position the member vertically and support it in preparation for insertion into the ground, a power means on the carriage including a vertical plunger coaxial with the vertically positioned member in said guiding and positioning means adapted to engage and force the member into the ground, a coacting delivery means mechanically coupled to said plunger and operated by upward movement of said plunger to deliver one member at a time from said supply to said guiding and positioning means, means including a clutch operated in response to the continuous movement of said body portion and connected with the carriage to drive the carriage on said guideway reversely to the movement of the body portion whereby the carriage can achieve a condition stationary relative to the ground when each rigid member is being inserted into the ground during said continuous movement of the body portion, and control and timing means on the machine to coordinate movements of the carriage and said power means.

2. A machine for inserting rigid members into the ground as defined in claim 1, and said continuously moving body portion comprising a frame having ground wheels and adapted to be towed by a tractor or the like, and said means including a clutch being driven by rotation of the ground wheels.

3. A machine for inserting rigid members into the ground as defined in claim 2, wherein said clutch is an electrical clutch, and said means including the clutch further comprises gearing connected between at least one ground wheel and an input component of the clutch and further gearing connected between an output component of the clutch and said carriage to drive the carriage rearwardly only when the electrical clutch is energized, and control circuitry including a cyclically operated switch to cause periodic energizing and engagement of the electrical clutch.

4. A machine for inserting rigid members into the ground as defined in claim 3, and the first-named gearing including a continuously rotating timer shaft, and a timer cam on such shaft to operate the cyclically operated switch.

5. A machine for inserting rigid members into the ground as defined in claim 1, and said carriage being underslung and depending from said body portion and having a cross member disposed near and above ground level on which said power means and coacting delivery means are mounted.

6. A machine for inserting rigid members into the ground as defined in claim 1, and said supply comprising a hopper containing a multiplicity of said rigid members in stacked relation horizontally, the hopper being tapered to form a lower horizontal corner in which only a single rigid member may rest, said delivery means including a horizontal delivery plunger coaxial with said single member to drive such member axially into the guiding and positioning means, the hopper having an opening adjacent to said corner including the horizontal delivery plunger.

7. A machine for inserting rigid members into the ground as defined in claim 6, and said guiding and positioning means comprising a generally L-shaped means having a horizontal portion adjacent said corner and a descending vertical portion into which each rigid member can move by gravity to be aligned coaxially with said vertical plunger.

8. A machine for inserting rigid members into the ground as defined in claim 5, and a yielding support element for each rigid member at the bottom of the descending vertical portion.

9. A machine for inserting rigid members into the ground as defined in claim 1, and said coacting delivery means including a horizontal delivery plunger coaxial with said single member, a carriage bar for the horizontal delivery plunger and supporting roller bed for the carriage bar on said carriage, and means including a flexible drive element connected between said carriage bar and said vertical plunger whereby upward movement of the vertical plunger advances the carriage bar and horizontal delivery plunger to discharge a rigid member from said supply.

10. A machine for inserting rigid members into the ground as defined in claim 1, and return spring means for said carriage and said delivery means.

11. A machine for inserting rigid members into the ground as defined in claim 1, and said power means comprising a vertical power cylinder having a piston carrying the vertical plunger, the power cylinder being double acting, a two-way valve operatively connected with the power cylinder to control extension and retraction of the vertical plunger, fluid supply means including a pump adapted to be driven by a power take-off shaft on said machine delivering pressurized fluid to said valve and power cylinder, and said control and timing means including means to operate said two-way valve.

12. A machine for inserting rigid members into the ground as defined in claim 11, wherein the two-way valve is a solenoid-operated valve and said means to operate the two-way valve includes switching means forming a part of the control and timing means and being electrically connected to solenoids of the two-way valve.

13. A machine for inserting rigid members into the ground as defined in claim 12, and high and low pressure sensors connected between the switching means and said power cylinder on opposite sides of the piston thereof carrying said vertical plunger.

14. A machine for inserting rigid members into the ground as defined in claim 12, and said control and timing means including an additional switch operated by said coacting delivery means to cause a brief interruption in the rearward movement of said carriage toward its final rearward position.

* * * * *